United States Patent [19]

Kime

[11] Patent Number: 4,832,193

[45] Date of Patent: May 23, 1989

[54] STORAGE CONTAINER

[76] Inventor: James W. Kime, Creative Industries International, Inc., P.O. Box 767397, Roswell, Ga. 30076

[21] Appl. No.: 263,034

[22] Filed: Oct. 26, 1988

Related U.S. Application Data

[63] Continuation-in-part of Ser. No. 115,341, Nov. 2, 1987, abandoned.

[51] Int. Cl.[4] ..... B65D 85/20

[52] U.S. Cl. ..... 206/372; 206/315.11; 206/373; 312/290; 312/DIG. 33

[58] Field of Search ..... 206/541, 545, 549, 315.11, 206/371, 372, 373, 576, 822; 220/20, DIG. 13; 312/283, 290, DIG. 33

[56] References Cited

U.S. PATENT DOCUMENTS

| | | | |
|---|---|---|---|
| 1,984,345 | 12/1934 | Kennedy | 206/373 |
| 2,457,043 | 12/1948 | Histand | 312/DIG. 33 |
| 3,092,428 | 6/1963 | Kerschner | 206/273 |
| 3,558,205 | 1/1971 | Mueller | 312/DIG. 33 |
| 4,303,158 | 12/1981 | Perkins | 206/373 |
| 4,366,998 | 1/1983 | Kaiser | 312/DIG. 33 |
| 4,659,154 | 4/1987 | Jenkins | 312/DIG. 33 |
| 4,768,652 | 9/1988 | Fallon | 206/373 |

*Primary Examiner*—David T. Fidei

*Attorney, Agent, or Firm*—Jennings, Carter, Thompson & Veal

[57] ABSTRACT

A portable container having a generally wedge shaped configuration utilizes a base portion and an upper portion hingedly connected at the vertical midpoint for separate storage compartments. The base portion includes a hingedly mounted door which latches to the base. The upper portion is secured in a closed position by the lip carried by the door which fits within a groove formed on the front of the top portion. An internal horizontal divider assures separation between the base and upper portion.

4 Claims, 4 Drawing Sheets

Fig. 1
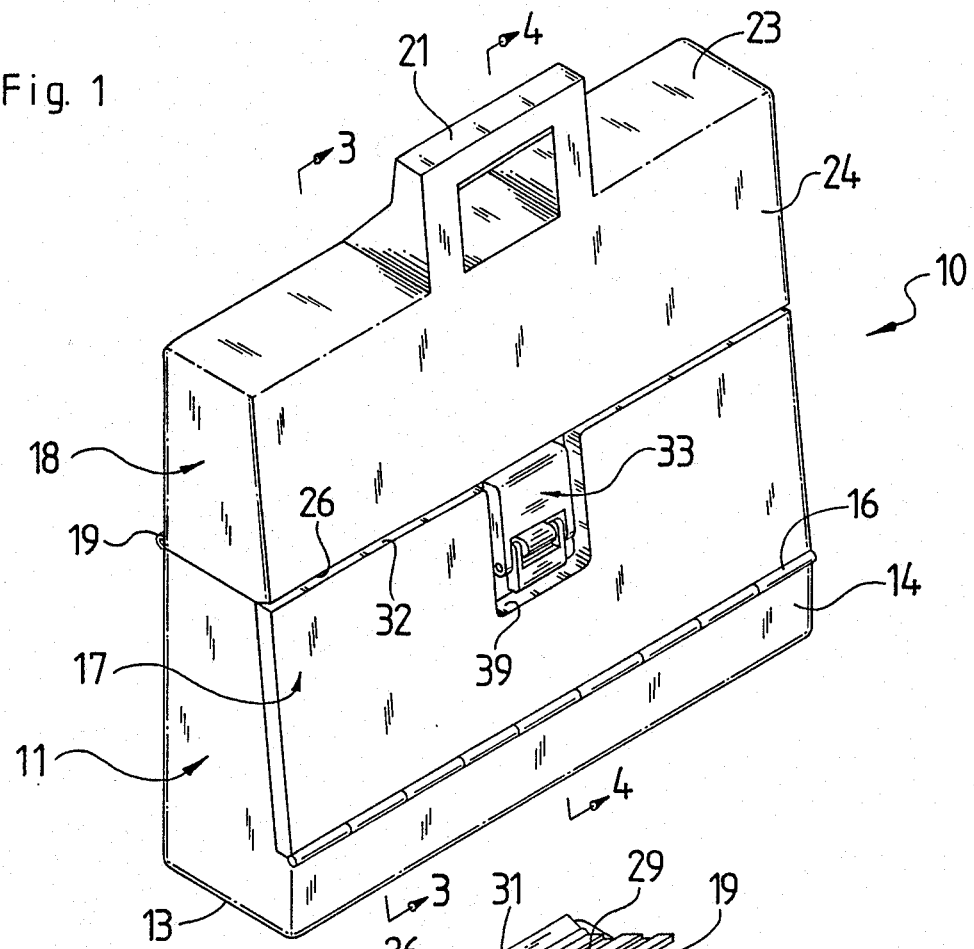
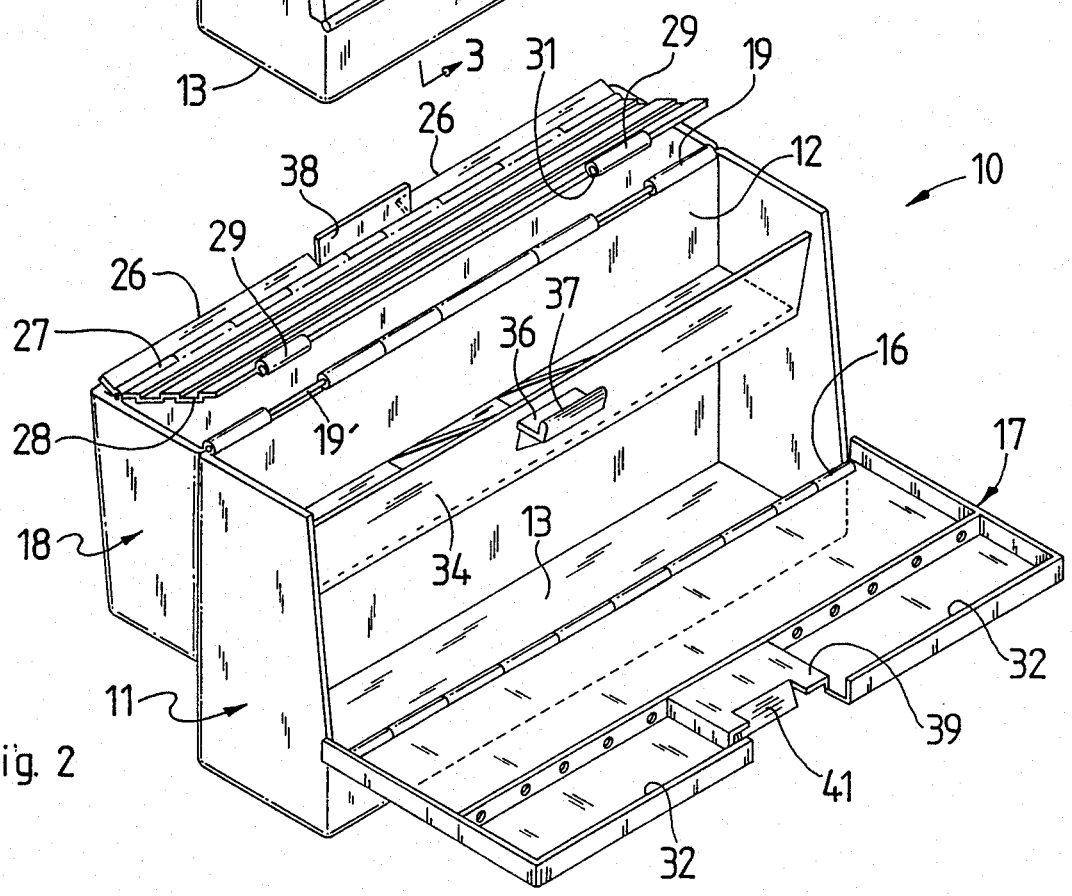
Fig. 2

STORAGE CONTAINER

This is a continuation-in-part of U.S. patent application Ser. No. 115,341 filed Nov. 2, 1987, now abandoned.

FIELD OF THE INVENTION

The present invention relates to storage containers and more particularly to containers which are adapted to fit in unusual spaces in vehicles such as behind the seat of a pick-up truck. More particularly, the present invention relates to storage containers specifically adapted to fit behind the seats of pick-up trucks and to maximize the storage capacity of such space.

BACKGROUND OF THE INVENTION

The pick-up truck has become the personal utility vehicle for a vast number of people. Numbered in this group are the traditional pick-up drivers such as farmers and construction workers, as well as a growing number of people who use the pick-up as both a work vehicle and a recreational vehicle. At one time, the pick-up owner utilized the space behind his seat to store his jack and tire irons. Eventually, this area became the storage place for hammers, screwdrivers and all sorts of useful articles. The useful articles were not very usefully located. As increasing number of painters, construction personnel and other artisans began using pick-ups rather than panel trucks, a need arose for tool and equipment storage that would be somewhat organized and which could be secured. Tool boxes were fashioned to fit between the sidewalls immediately behind the cab in the bed of the truck. While such compartments have generally served the purpose of the craftsman or artisan, not everyone who wishes to store his equipment has need of such space and furthermore, it is somewhat inconvenient to return to the truck to swap tools. This problem was partially addressed by my uniquely shaped tool box disclosed in U.S. patent application Ser. No. 758,429 entitled "CARRIER CASE" which is incorporated herein by reference. The "CARRIER CASE" did not completely solve the problem in that it left something to be desired in terms of its internal capacity, particularly with respect to the efficient utilization of such capacity.

SUMMARY OF THE INVENTION

It is the object of the present invention to maximize the usable storage space available in a portable storage container which may be placed behind the seat of a truck.

Another object of the invention is to provide a container as described above which is stable and self-supporting when opened.

To accomplish these objects, my invention utilizes a generally triangular shape similar to the shape of my "CARRIER CASE" of Ser. No. 758,429. That is to say, the present invention utilizes a wedge shape which fits behind a truck seat between the back of the seat and the rear wall of the cab. In its normal upright position, the container rests on a narrow base and tapers upwardly to a top, with one side remaining vertical and the other inclined toward the vertical side. The container is hinged at its vertical midpoint such that a top and bottom portion are formed with the top including a rigid handle. When the top is opened to its full extent, the handle assists in supporting the top portion as it rests against the side of the bottom portion. In certain embodiments, the top and bottom portion may be divided into additional compartments for segregated storage of various items.

BRIEF DESCRIPTION OF THE DRAWINGS

Apparatus embodying features of my invention are depicted in the accompanying drawings which form a portion of this disclosure and wherein:

FIG. 1 is a perspective view of my invention;

FIG. 2 is a perspective view of the container shown in FIG. 1 in an open position;

DESCRIPTION OF A PREFERRED EMBODIMENT

Figure 5:
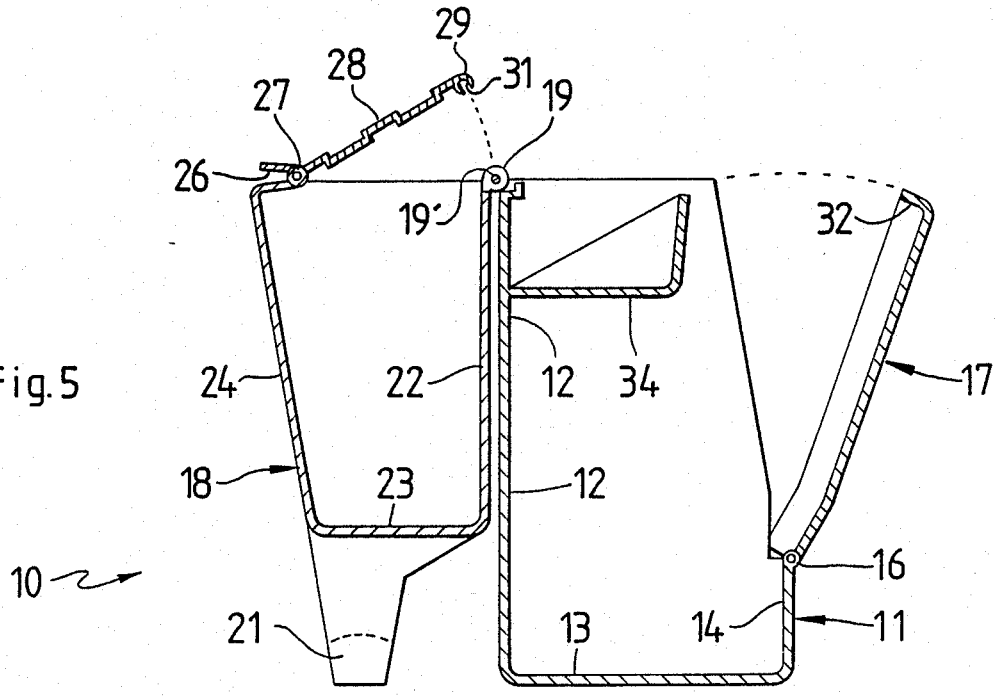
FIG. 5 is a sectional view corresponding to FIG. 3 with the container shown in an open position.

Referring to the Drawings for a better understanding of the invention, it will be noted in FIGS. 1, 2, 3, 4 and 5 that the invention comprises a container 10 having a generally wedge-shaped appearance. The container rests on a base portion 11 and has a vertical rear wall 12 which extends vertically from a bottom 13 and vertical forward wall 14 which is substantially shorter than the vertical wall 12. A hinge joint 16 is provided at the top of the forward wall 14 to pivotally mount an inclined door 17. The container also has an upper portion 18 which is jointed to the base 11 along a hinge 19 at the top of rear wall 12. The upper portion 18 includes a rigid handle 21. The distance from hinge 19 to the top of the handle 21 is the same as the distance from the hinge 19 to the bottom of the base portion 11; therefore, as is illustrated in FIG. 5, the handle 21 serves to support the upper portion 18 when the container is open. The handle 21 is also offset for balance at the center of gravity of the container.

Figure 3:
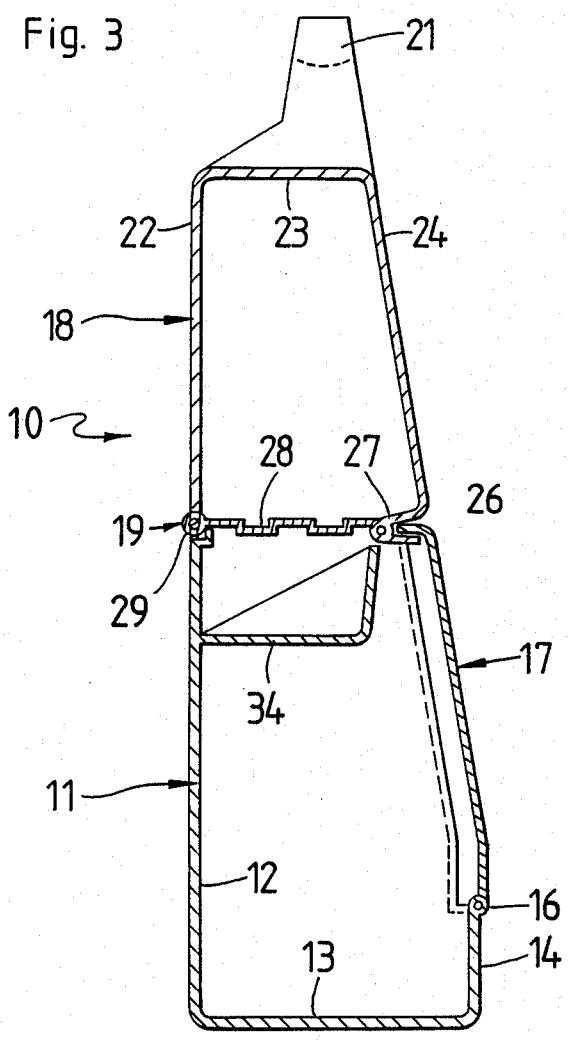
FIG. 3 is a sectional view taken along line 3—3 of FIG. 1.
Figure 4:
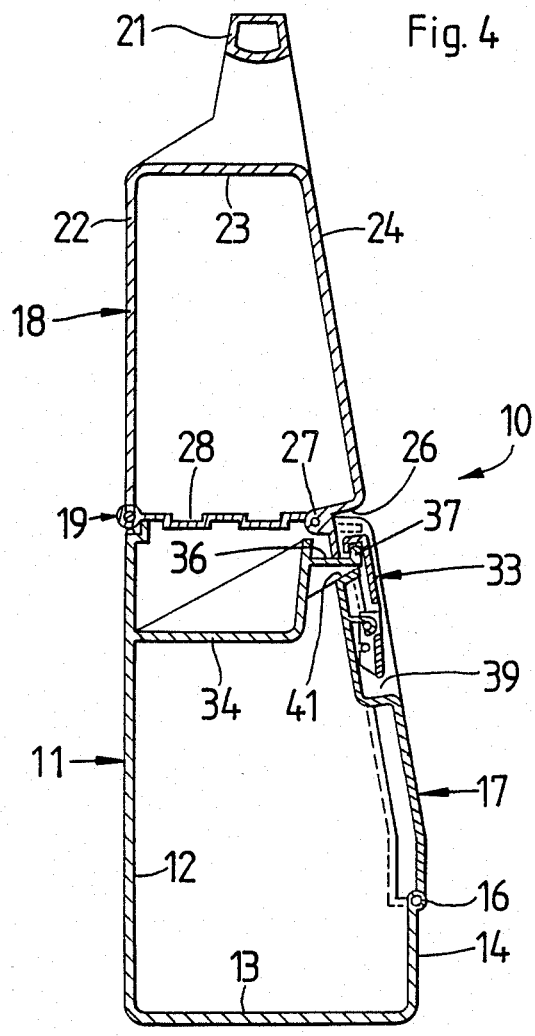
FIG. 4 is a sectional view taken along line 4—4 of FIG. 1.
Figure 6:
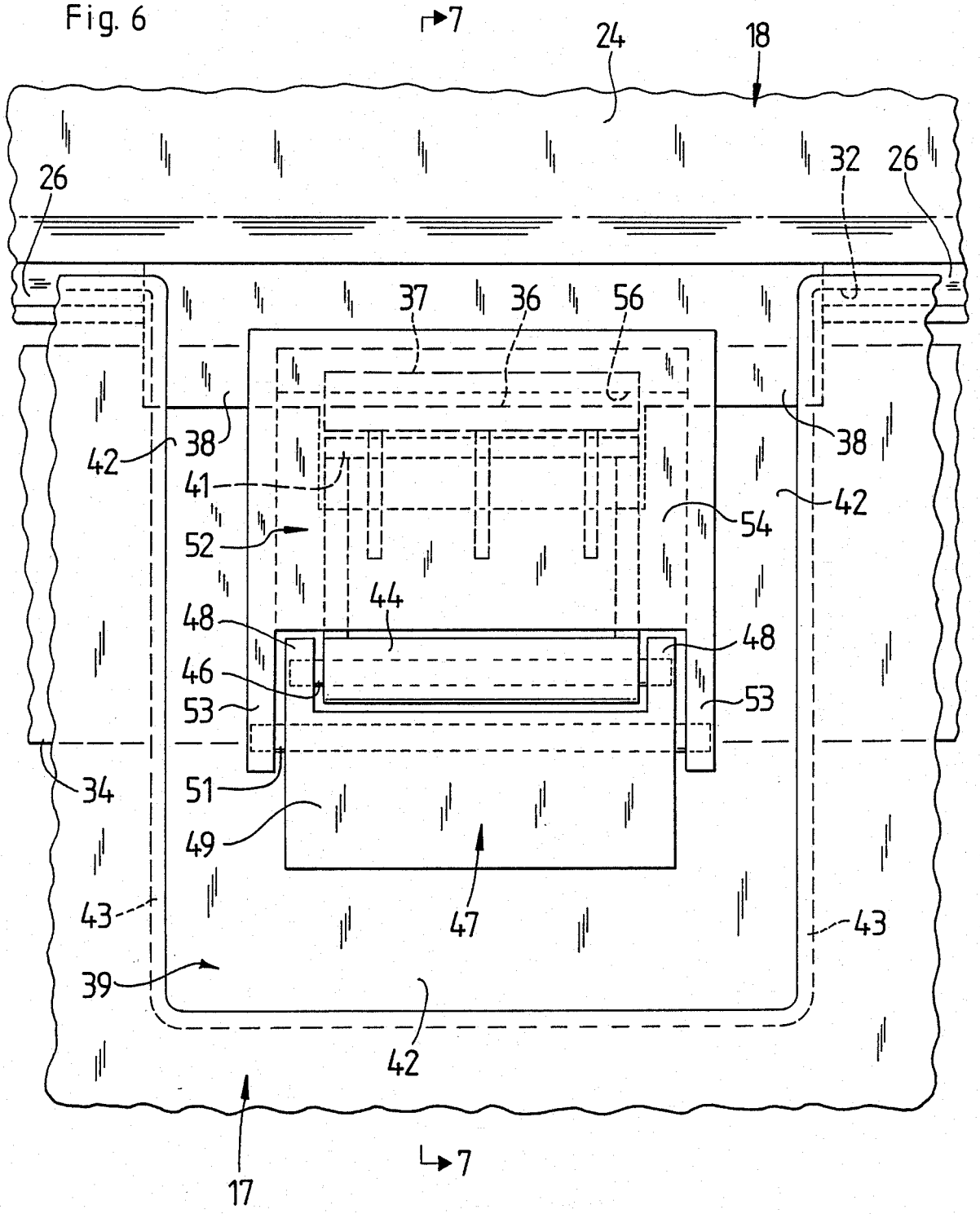
FIG. 6 is a detailed elevational view of the latch mechanism.
Figure 7:
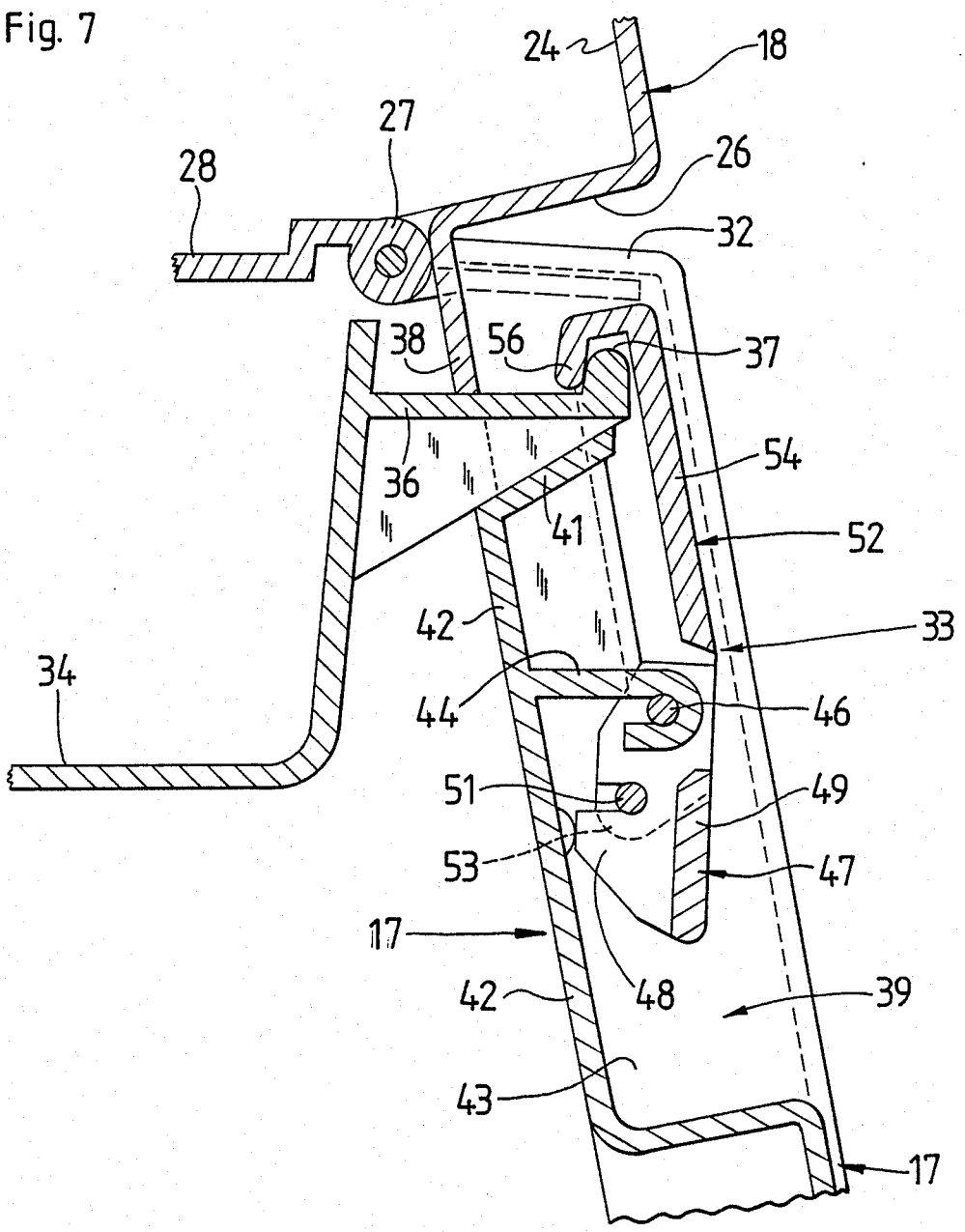
FIG. 7 is a sectional view taken along line 7—7 of FIG. 6.

As may be seen in FIG. 3, the upper portion 18 includes a rear vertical wall 22, a top 23, and an inclined front wall 24 which slants away from the rear wall 22. An outwardly opening V-shaped groove 26 is formed in the front wall 24. At the apex of the groove and internally of the upper portion 18 is a hinge joint 27 which pivotally supports a horizontal divider 28. The horizontal divider 28 terminates in a rounded member 29 which has formed therein a radially opening slot 31 adapted to receive therein a rod 19' which is the hinge pin of hinge 19. As may be seen in FIGS. 3–5, the horizontal divider 28 will be locked in position when the upper portion 18 is closed and may be opened when the upper portion 18 is also open. FIG. 3 also shows the interaction of the top portion 18 and the door 17. As will be noted the door 17 forms an inwardly extending lip 32 which mates with V-shaped groove 26 to secure the upper portion 18 to base 11. The door 17 is in turn secured by a latch mechanism 33, shown in FIGS. 4, 6 and 7.

The door 17 does not latch to the upper portion 18, but rather latches to the base 11. A horizontally extending member 34, which may be a tray or the like, is supported by vertical wall 12 and extends toward the door 17. The outermost portion of member 34 includes a horizontal extension 36 and an upturned rib 37. The V-shaped groove 26 is interrupted across the width of the horizontal extension 36 and the lower leg of the V-shaped groove 26 is replaced with a downwardly extending member 38. Likewise the inwardly extending lip 32 on door 17 is modified to form a latch recess shown generally at 39. The latch recess 39 is a continuation of door 17 and includes a stop 41 which abuts against horizontal extension 36, and a recessed wall 42 which extends upwardly on either side of horizontal extension 36, to abut downwardly extending member 38, and cooperative recess sidewalls 43 formed in the surface of the door 17. A latch carrier 44 in the form of an outwardly extending hook-shaped channel is formed integrally with recessed wall 42 and carries within its hook-shaped portion a first latch pin 46. A latch lift piece 47, having a pair of clevis like legs 48 which engage the first latch pin 46, and a body 49. The body 49 carries therewithin a second latch pin 51 which pivotally supports a latch hook member 52. The latch hook member 52 also has a pair of pin engaging legs 53 which receive pin 51 therethrough and a body portion 54 which includes a downturned flange 56 which engages rib 37. As may be seen, pivotal motion of latch member 47 about the first latch pin 46 causes relative motion between the latch hook member 52 and the upstanding rib 37 to effect latching and unlatching of the door 17 to the horizontal extension 36. It will be appreciated that with the door 17 latched and the lip member 32 resting in the V-shaped groove 26, the container may be carried by handle 21 since the upper portion 18 is secured to the lower portion 11.

FIGS. 1 and 2 are perspective views of my invention configured as a tool box, showing the cooperation of the component parts in the open and closed positions. It will be appreciated that my box may be compartmentalized as in the manner shown in my co-pending U.S. patent application Ser. No. 115,341 of which the present application is a continuation-in-part. Also as noted in Ser. No. 115,341, my container may be configured as a tackle box by the utilization of appropriate internal compartments. In such an embodiment, the door 17 can be formed of a clear plastic with a plurality of lure compartments formed therein.

From the foregoing, it may be seen that my invention is subject to a plurality of adaptations and modifications to suit particular needs, however, it appears that the embodiments shown herein will provide satisfactory portability and storage for most users.

While I have shown my invention in one form, it will be obvious to those skilled in the art that it is not so limited but is susceptible of various changes and modifications without departing from the spirit thereof.

What I claim is:

1. A portable container designed to fit behind the seat of a truck comprising:

(a) a base portion including a rear vertical wall, a horizontal bottom, vertical end walls, a front vertical wall having a height less than said rear wall and a door hingedly mounted to said front vertical wall with said door being inclined toward said rear vertical wall in a closed position and having a rearwardly extending lip formed thereon along an edge thereof distal said front vertical wall;

(b) a member extending generally horizontally from said rear wall at a predetermined height beneath the top thereof, said member terminating in an upturned horizontal rib-like member;

(c) latch means carried by said door for engaging said rib and securing said door thereto; and (d) a top portion having a rear vertical wall hingedly connected to the top of said rear vertical wall of said base portion, a generally horizontal top supporting a rigid handle, a pair of generally vertical trapezoidally shaped end walls, and an inclined front wall extending from said top sloping away from said rear wall, said front wall having an outwardly opening V-shaped channel formed therein distal said top for receiving said rearwardly extending lip therewith.

2. A portable container as defined in claim 1 wherein said base portion and said top portion are hingedly connected by at least one rod-like member extending through sleeves cooperatively formed on said base and top portion, and further comprising a horizontal divider mounted to said inclined front for pivotal motion about a horizontal axis adjacent said V-shaped groove and having a rounded terminal portion having a radially opening slot for receiving said rod-like member therein.

3. A portable container as defined in claim 2 wherein said latch means comprises:

(a) a latch pivot member formed on said door and extending therefrom supporting a horizontally disposed first pin;

(b) a first latch member having a pair of clevis-like legs engaging said first pin, said first latch member being movable about an axis defined by said first pin, and a body portion supporting a second pin;

(c) a second latch member having a pair of clevis-like legs engaging said second pin and a body portion including a hook-like portion formed distal said second pin and adapted to receive said rib-like member therewithin.

4. A portable container as defined in claim 1 wherein said latch means comprises:

(a) a latch pivot member formed on said door and extending therefrom supporting a horizontally disposed first pin;

(b) a first latch member having a pair of clevis-like legs engaging said first pin, said first latch member being movable about an axis defined by said first pin, and a body portion supporting a second pin;

(c) a second latch member having a pair of clevis-like legs engaging said second pin and a body portion including a hook-like portion formed distal said second pin and adapted to receive said rib-like member therewithin.

* * * * *